United States Patent [19]

Niepmann

[11] 3,977,282

[45] Aug. 31, 1976

[54] DEVICE FOR CUTTING ENVELOPE FOR A CIGARETTE BLOCK

[75] Inventor: Otto Niepmann, Gevelsberg, Germany

[73] Assignee: Maschinenfabrik Fr. Niepmann & Co., Gevelsberg, Germany

[22] Filed: June 13, 1974

[21] Appl. No.: 479,251

Related U.S. Application Data

[62] Division of Ser. No. 282,611, Aug. 21, 1972, Pat. No. 3,845,697.

[30] Foreign Application Priority Data

Dec. 28, 1971 Germany ..... 2164925

[52] U.S. Cl. ..... 83/156; 83/436; 83/911

[51] Int. Cl.[2] ..... B26D 1/36; B65H 5/06; B65H 35/08

[58] Field of Search ..... 83/156, 911, 404.2, 83/404.4, 408, 436

[56] References Cited

UNITED STATES PATENTS

| | | | |
|---|---|---|---|
| 1,303,371 | 5/1919 | Novick | 83/911 X |
| 2,696,255 | 12/1954 | Heywood | 83/911 X |
| 2;951,408 | 9/1960 | Novick | 83/911 X |
| 3,244,045 | 4/1966 | Aronson et al. | 83/911 X |

*Primary Examiner*—Frank T. Yost
*Attorney, Agent, or Firm*—Walter Becker

[57] ABSTRACT

A device for feeding a foil blank and envelope made therefrom for enveloping a cigarette block in a cigarette wrapping machine with side folds on the narrow sides. The foil sections which overlap each other at the narrow sides of the envelope extend at a slant. The width of the respective outer side increases toward the head portion of the envelope in such a way that the corner during the preparation of the head fold rests on the last cigarette of the outermost cigarette row.

2 Claims, 6 Drawing Figures

PRIOR ART

DEVICE FOR CUTTING ENVELOPE FOR A CIGARETTE BLOCK

This is a division of co-pending application Ser. No. 282,611-Niepmann filed Aug. 21, 1972, now U.S. Pat. No. 3,845,697-Niepmann issued Nov. 5, 1974.

The present invention relates to an envelope for enclosing a block of cigarettes in a cigarette wrapping machine with lateral folds on the narrow sides and, more specifically, concerns an envelope of this type which is made from a foil blank. The invention furthermore relates to a method of preparing the envelope and to a device for practicing this method.

Cigarettes wrapped in cigarette packs are in addition to the wrapper proper surrounded by an envelope of a foil laminated with aluminum, the foil tightly enclosing the block formed by the cigarettes. The foil blank of the envelope surrounding the cigarette block has heretofore been placed parallel to the edges of the cigarette block in order to permit a proper folding. In particular with an uneven number of cigarettes in the rows of the cigarette block which are closely arranged adjacent to each other, a considerable overlapping of the lateral folds is necessary in order to assure that during the folding of the top fold no bulges will form. In view of the overlapping of the two blank parts at the lateral folds, the lateral overlapping portions respectively rest on the last cigarette of the outermost rows so that also a depression between the outer rows cannot cause any faults when effecting the top fold.

It is an object of the present invention to provide an envelope of the above described type from a foil blank which will permit a complete enveloping of the cigarette block and a proper folding with a minimum quantity of material.

It is another object of this invention to provide a method of and device for making an envelope as set forth in the preceding paragraph which without difficulties and major costs and technical efforts can be practiced in a cigarette wrapping machine.

These and other objects and advantages of the invention will appear more clearly from the following specification in connection with the accompanying drawings, in which:

FIG. 1 diagrammatically illustrates a cross section through a portion of a cigarette block surrounded by an envelope as it represents the present state of the art.

FIG. 2 shows a foil blank for the envelope of FIG. 1.

FIG. 3 diagrammatically illustrates a cross section through a portion of a cigarette block surrounded by an envelope according to the invention.

Figure 1:
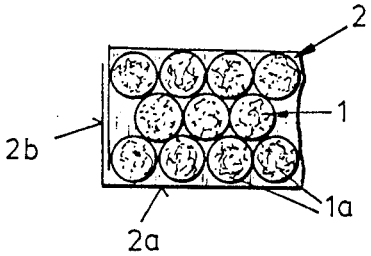

The envelope according to the invention is characterized primarily in that the foil portions which overlap at the narrow sides extend at an incline while the width of the respective outer portion increases toward the top side of the envelope in such a way that the corner during the forming of the top fold rests on the last cigarette of the outermost row.

In view of the inclined extension of the foil portions which pertain to the side folds and overlap at the narrow sides, it is possible to reduce the total width of the employed foil section by approximately 10% so that a considerable saving in material is obtained. Inasmuch as the location of the outwardly located blank portion of the side folds within the region of the top portion corresponds to the heretofore known arrangement, no drawbacks are encountered when preparing the top fold. The inclined extension of the overlapping foil portions cannot be seen by the buyer of the cigarettes in view of the outer wrapping and at the top side of the inwardly located blank portion similarly the small width is not visible from the outside which last mentioned blank portion covers merely the last cigarette of the adjacent row.

The method for making the envelope according to the present invention is characterized primarily in that the rectangular foil cross section is prior to enveloping the cigarette block placed at an incline. This placing at an incline represents such a simple method that it can be carried out by most simple means without interfering with the heretofore customary steps.

Starting with the device comprising a cutting device separating the foil blank from a roll of foil and including a cutting roller with counter roller and also comprising a folding device for forming the envelope, it is suggested in conformity with the invention that the cutting device is followed by a roller pair which cooperates with resilient counter rollers and in which the two rollers rotate at different circumferential speeds. According to a further feature of the invention the two rollers are connected to a common shaft and have different diameters.

While heretofore it was necessary, between the cutting device and a folding device for forming the envelope, to provide transporting rollers, the device for practicing the method according to the present invention merely requires that in the transporting path between the cutting device and the folding device there is arranged one roller pair which in view of the different diameters of the rollers has different circumferential speeds so that after the cut off foil blank has been grasped, a placing of the foil blank into a slightly inclined position is effected prior to the foil blank reaching the folding device. The invention can thus be practiced by extremely simple means so that a considerable economic advantage is realized.

A further saving in material is obtained when the knife in the cutting roller is, in conformity with the present invention, arranged at an angle with regard to the axis of rotation which angle corresponds to that angle by which the foil blank is inclined. In this way a front and a rear cut edge is obtained on the foil blank which edges will be parallel to the edges of the cigarette block to be enclosed after the placing of the foil blank at an incline. The envelope thus not only obtains a top fold with parallel edges but also yields a further saving in material.

Figure 2:
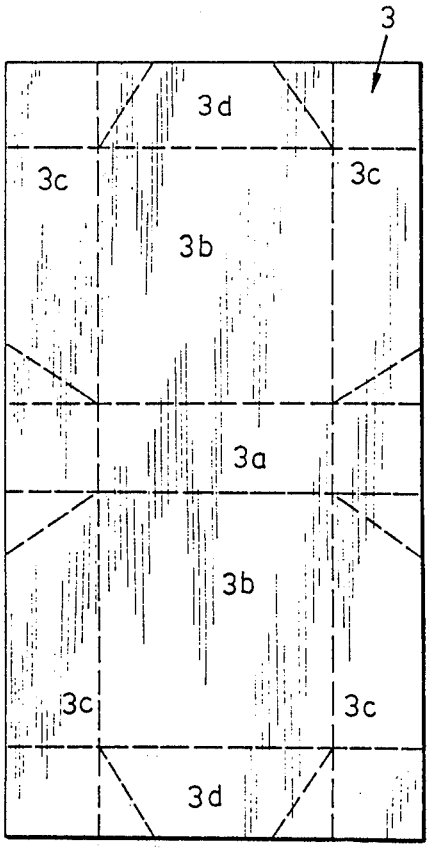

Referring now to the drawings in detail, the cigarette block 1 illustrated in FIG. 1 and comprising three rows of cigarettes 1*a* is surrounded by an envelope 2 which is made of a foil blank 3 in conformity with FIG. 2. The foil blank 3 is in a manner known per se folded by means of lateral folds on the narrow sides 2*b* to form an envelope 2 while the narrow sides 3*c* of the foil blank 3 overlap to a great extent. The wide sides 2*a* of the envelope 2 are formed by the wide sides 3*b* of the foil blank 3 which latter has a smooth bottom 3*a*. The withdrawal opening of the envelope 2 on the top side is formed by top portions 3*d* of the foil blank 3 after the cigarette block 1 has been introduced into the envelope 2.

As will be seen in particular from FIG. 1, with the blank 3 according to the present state of the art it is necessary that the narrow sides 3*c* of the foil blank for purposes of forming the lateral folds overlap nearly completely in order to make sure that when forming the top fold the narrow sides 3*b* will be supported on the last cigarettes 1*a* of the two outer rows of the cigarette block 1 so that errors during the folding operation will be prevented which otherwise easily occur in view of the free space in the center of the narrow side.

Figure 3:
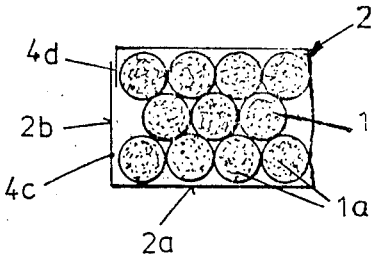
Figure 4:
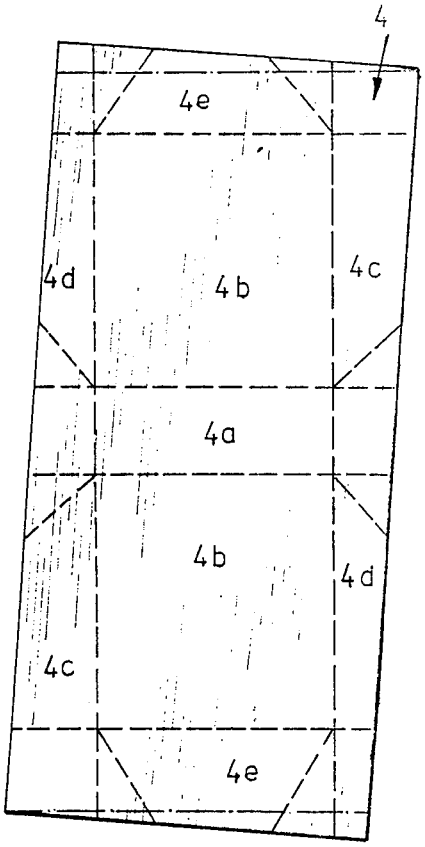
FIG. 4 represents a foil blank according to the invention.

In order to avoid the double overlapping on the narrow sides 2*b* of the envelope 2 as it is necessary with the arrangement according to the present state of the art, it is suggested in comformity with the present invention that the foil blank 4 according to FIGS. 3 and 4 be placed at an incline or slant. As a result thereof, the width of the blank section 4*c* increases toward the top side of the envelope 2 in such a way that the corner will during the forming of the top fold rest upon the last cigarette 1*a* of the outermost row. The blank section 4*d* of the blank 4 which at this area is narrow merely covers the last cigarette 1*a* of the adjacent row as is particularly clearly shown in FIG. 3.

In view of the just described arrangement, it is possible to make the foil blank 4 narrower than is necessary with the heretofore known foil blank 3. The saving in material realized in this manner amounts to about 10% over the material necessary with arrangements according to the present state of the art. The blank portions 4*d* which rest either only on the last cigarette 1*a* of the adjacent row and the blank sections 4*c* which rest on the cigarettes 1*a* located at the corners of the cigarette block 1 will in spite of the hollow space at the narrow side 2*b* of the envelope 2 assure a proper folding operation and a complete enclosure of the cigarette block 1. In view of the placing of the narrower foil blank 4 at a slant, no change as far as the remaining manufacturing steps of the envelope 2 are concerned will be necessary because also the foil blank 4 is provided with a smooth bottom 4*a*, with the customary wide sides 4*b* and with the top portions 4*e* which, after insertion of the cigarette block 1 into the envelope 2 which is open at the top side, form the top fold.

Figure 5:
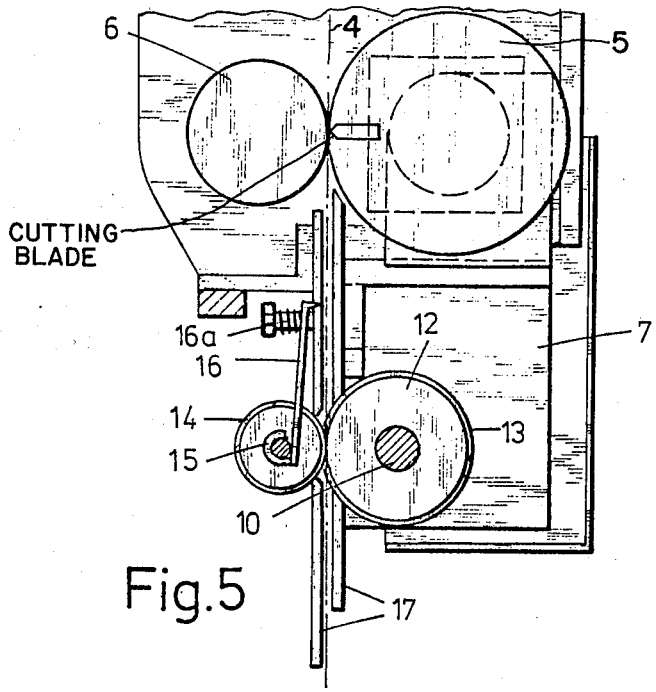
FIG. 5 is a partial section and partial side view of a device according to the invention for placing the foil blank in an inclined position.
Figure 6:
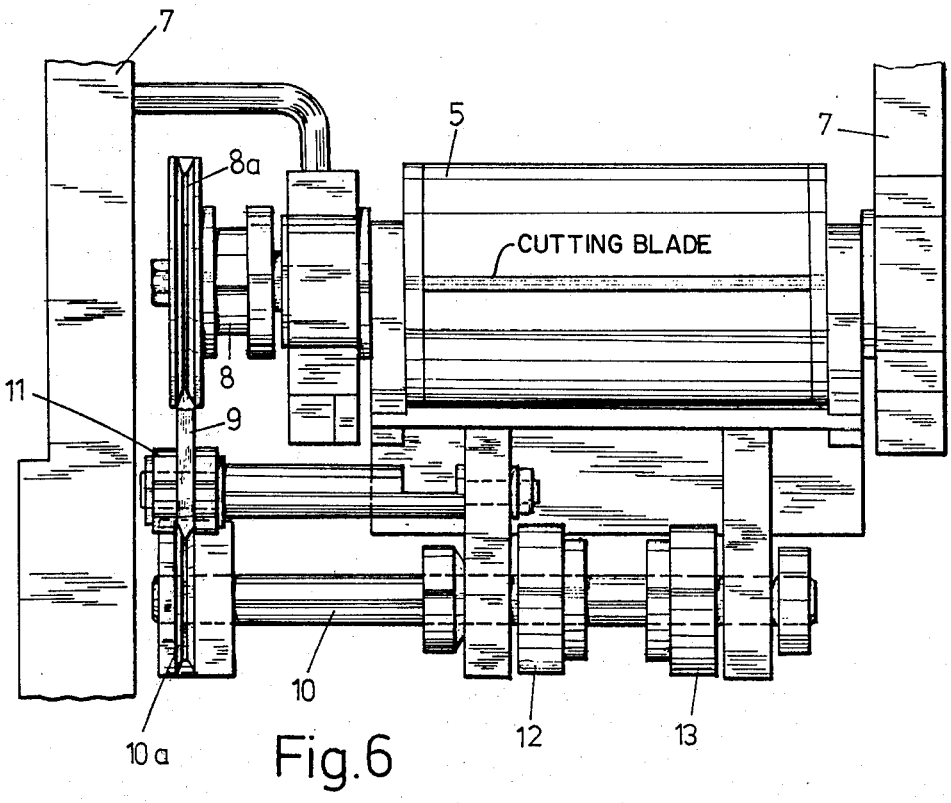
FIG. 6 is a front view of the device shown in FIG. 5.

FIGS. 5 and 6 illustrate a device for placing the foil blank 4 at a slant in a cigarette wrapping machine. The foil blank 4 which is withdrawn from a roll or reel is cut off by a cutting device which comprises a cutter roller 5 and a counter roller 6, both rollers being journalled in a frame 7. The cutter roller 5 is connected to a drive shaft 8 which by means of a pulley 8*a* is by a belt 9 drivingly connected to a shaft 10 which likewise has keyed thereto a pulley 10*a*. Keyed to shaft 10, which in feeding direction of the foil blank 4 is arranged behind the cutting device, are two rollers 12 and 13 respectively cooperating with counter rollers 14 and 15. Each of these counter rollers 14 and 15 is journalled on a lever 16 which is slightly pivotable against the thrust of a spring 16*a*.

In order to realize the placing of the foil blank 4 at a slant after it has been cut off by the cutting device, the roller 13 has a slightly larger diameter than the roller 12. Inasmuch as both rollers 12 and 13 are keyed to the same shaft 10, a slightly higher circumferential speed of the roller 13 is obtained. As a result thereof, the rollers 12 and 13 bring about a predeterminable slanting of the foil blank 4 guided between the guiding plates 17 as soon as the blank 4 has been cut off from the foil roll by the cutting device. The foil blank 4 thus will in slanted position move into the folding device following the cutting device so that during the folding operation the folding lines indicated in dash lines in FIG. 4 will be obtained. FIG. 6 shows that the tension of the belt 9 is maintained by a tension roller 11.

FIG. 4 shows in dot-dash lines the course of the cut which is obtained when the knife in the cutter roller is arranged at an angle with regard to the axis of rotation, this angle corresponding to the angle by which the foil blank 4 is inclined or slanted by the rollers 12 and 13. As will be evident from this figure, the slanted arrangement not only brings about that the blank portions for the top fold will be symmetrical but also results in a further saving in material.

It is, of course, to be understood that the present invention is, by no means, limited to the particular showing in the drawings but also comprises any modifications within the scope of the appended claims.

I claim:

1. A device for feeding a foil blank of rectangular contour in a cigarette wrapping machine in an inclined position with regard to the feeding direction, which includes cutter roller means for receiving and cutting foil material to a desired length, two pairs of control roller means following said cutter roller means when looking in the feeding direction of said device for respectively receiving therebetween the cut foil leaving said cutter roller means, and driving means for driving said control roller means, the roller means of one pair of said control roller means being rotatable at a higher circumferential speed than the roller means of said other pair of control roller means whereby said cut foil is fed at an angle in said device said cutter roller means including cutting blades extending relative to the axis of rotation of said cutter roller means at an angle corresponding to the angle at which the cut foil is fed in said device.

2. A device according to claim 1, which includes a driving shaft, and in which one roller means of each pair or roller means is keyed to said driving shaft, one of said roller means on said shaft having a diameter greater than the other roller means on said shaft.

* * * * *